US008721507B2

(12) United States Patent
Blancher

(10) Patent No.: US 8,721,507 B2
(45) Date of Patent: May 13, 2014

(54) MULTI-PLANAR RESISTANCE BAND EXERCISE SYSTEM

(76) Inventor: Vaughan Martin Blancher, Toronto (CA)

( * ) Notice: Subject to any disclaimer, the term of this patent is extended or adjusted under 35 U.S.C. 154(b) by 181 days.

(21) Appl. No.: 13/085,539

(22) Filed: Apr. 13, 2011

(65) Prior Publication Data

US 2011/0251033 A1 Oct. 13, 2011

Related U.S. Application Data

(60) Provisional application No. 61/323,466, filed on Apr. 13, 2010.

(51) Int. Cl.
*A63B 21/00* (2006.01)

(52) U.S. Cl.
USPC ..... 482/121; 482/126; 482/130; 482/129

(58) Field of Classification Search
USPC ..... 482/121, 124, 126, 130, 129
See application file for complete search history.

(56) References Cited

U.S. PATENT DOCUMENTS

| | | | | |
|---|---|---|---|---|
| 5,387,171 | A | 2/1995 | Casey et al. | |
| 5,830,110 | A | 11/1998 | Fielding | |
| 5,993,362 | A * | 11/1999 | Ghobadi | 482/124 |
| 6,634,998 | B2 * | 10/2003 | Siaperas | 482/142 |
| 7,794,374 | B1 * | 9/2010 | Park | 482/122 |
| 2007/0037678 | A1 | 2/2007 | Schaefer et al. | |

* cited by examiner

*Primary Examiner* — Jerome w Donnelly
(74) *Attorney, Agent, or Firm* — Symbus Law Group LLC; Clifford D. Hyra

(57) ABSTRACT

The present invention describes a portable resistance band exercise system used for training muscles, which may be used in a multi-planar workout routine, allowing various muscle groups to be exercised simultaneously. The user attaches each of one or more body attachment fasteners to one or more resistance bands, which are in turn attached to attachment points on a board. The attachment points are arranged in a semi-circular orientation on the board. The board may be used horizontally or upright, to permit a variety of exercises to be performed. Said exercise system also employs an ankle strap which has bumpers to cushion the user's shin and a foot strap to prevent the ankle strap from sliding up the user's lower leg.

15 Claims, 9 Drawing Sheets

FIG. 1
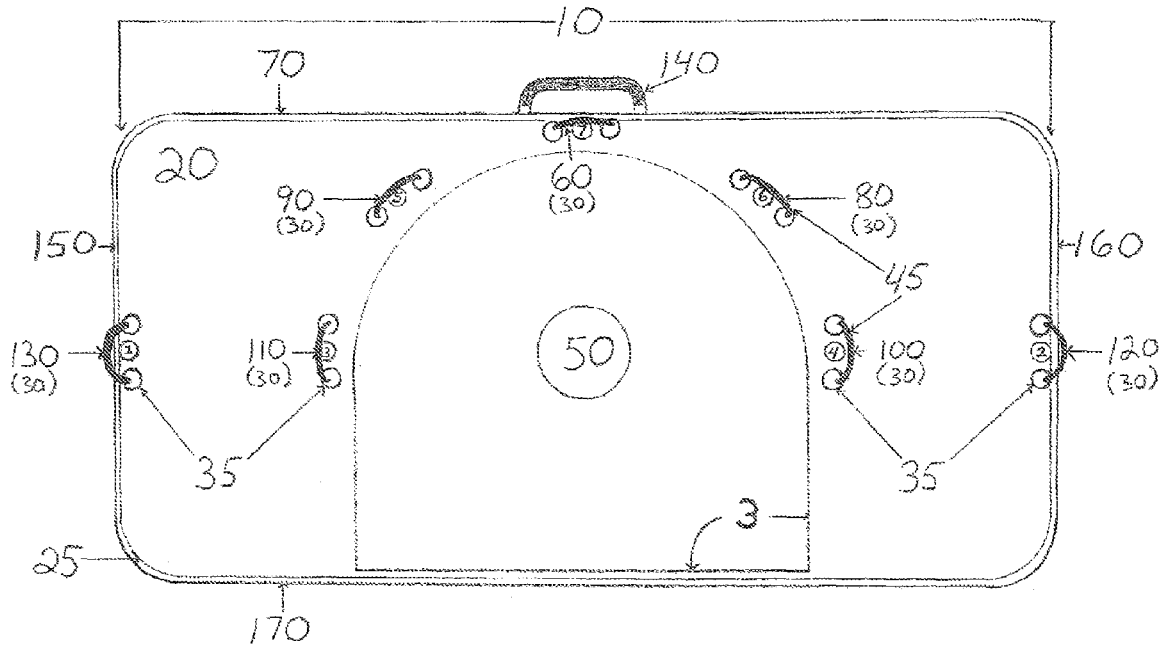
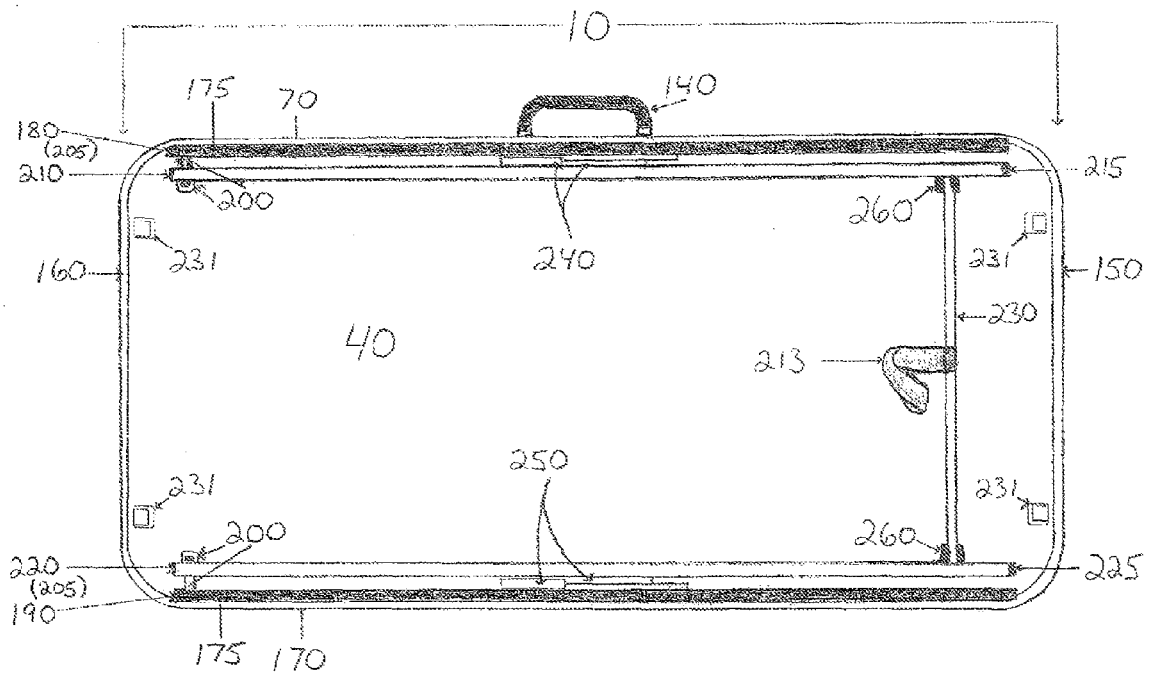
FIG. 2

(70)

(170)

(390)

MULTI-PLANAR RESISTANCE BAND EXERCISE SYSTEM

CROSS-REFERENCE TO RELATED APPLICATIONS

This application claims the benefit of U.S. provisional patent application Ser. No. 61/323,466, filed on Apr. 13, 2010, all of which is incorporated by reference as if completely written herein.

STATEMENT REGARDING FEDERALLY SPONSORED RESEARCH OR DEVELOPMENT

Not applicable.

TECHNICAL FIELD

The invention relates generally to exercise devices and in particular to portable devices that provide resistance training for muscles using resistance bands.

BACKGROUND OF THE INVENTION

Resistance training provides many benefits for the human body, among them strengthening and toning the muscles, improving cardiovascular condition and reducing body fat stores, as well as increasing bone density. Allowing the body to work in multiple planes (in which a user moves in more than one direction at once) benefits the body by working muscles in ways in which the muscles work every day, sideways, backwards, forward, and diagonally, often at the same time. Furthermore, unbalancing the body while in the course of exercise brings about additional benefits such as proprioception and the strengthening of neutralizer and stabilizer muscles both of which aid in balance. Resistance training is easier to engage in, and will be engaged in more frequently for greater benefit, if the device is portable and can be folded away, under the bed for example, and is of a reasonable weight and size.

Typically, resistance training may consist of weights, weight machines, resistance bands or the use of the body's weight, which are pushed or pulled in order to resist muscle movement. Most resistance training devices are insufficient, in that they are unable to provide a balanced workout using multiple planes and balance elements, while also being portable. For example, weights are heavy and require benches and other accessories to provide a workout which includes multiple muscle, groups. Weight machines are typically bulky, expensive and must be permanently installed in a gym, for example, and operate in only one plane at a time, so a more demanding and beneficial multi-planar workout would be impossible with such machines. Also, many machines do not permit inclusion of a balance component. The use of body weight for resistance training is portable and convenient, however body weight is static, in that it cannot be adjusted for higher or lower resistance and the muscle groups that one may exercise by means of body weight is limited to the position of the body, and some positions may be uncomfortable or downright impossible. Therefore, a portable workout system using resistance bands, such as springs, elastic bands and elastic tubes, which is capable of providing a variety of exercises in a variety of planes, with the potential to use instability for balance training, is desirable. The prior art has not successfully addressed these deficiencies.

U.S. Pat. No. 5,387,171 discloses a resistance-band machine that uses a chair-like structure as a workout bench to provide a variety of exercises for the user, with the level of resistance variable by means of the resistance bands. This machine, while providing some benefits, is not portable, and only provides a limited range of exercises to the user.

In U.S. Pat. No. 5,830,110, a spring-actuated portable weight training device is disclosed; however its application is limited to a few exercises which require compression between two points, such as between the wrists when the user is performing chest flys. It does not allow a user to pull against a static point, for example.

U.S. Patent Application No. 2007/0037678 discloses an exercise system which comprises a rigid backing member, and having resistance bands attached to handles on the sides, to facilitate a variety of exercises. However, the invention does not provide a means to use the balance of an individual during the exercise and due to the resistance band placement and the use of handles only instead of bodily attachment straps, the range of possible exercises is limited.

Accordingly, due to the shortcomings of the prior art, there remains a need for a portable exercise system which uses resistance bands to permit a user to engage in a variety of exercises in a variety of planes, with the option of using his or her balance to augment the benefit of the exercise.

SUMMARY OF THE INVENTION

The present invention comprises a portable free-motion exercise system for strengthening muscles, comprising a board, a plurality of attachment points on said board, and one or more resistance bands, wherein the one or more resistance bands are detachably connected to one or more attachment points. The user then applies force to the resistance bands, optionally with the aid of one or more body attachment fasteners, which are detachably connected to said resistance bands and may consist of handles, a bar and ankle straps among others.

Furthermore, the present invention discloses a method of using said portable free-motion exercise system, comprising the steps of connecting a first end of one or more resistance bands to one or more attachment points, connecting a second end of said resistance bands to one or more body attachment fasteners, stabilizing the board with oppositional forces, and applying force to said body attachment fasteners one or more times.

As a body attachment fastener for the portable free-motion exercise system, an ankle strap is disclosed, comprising an ankle strap with fastening means, a foot strap with fastening means, and a ring affixed to said ankle strap, wherein said ankle strap is fastened around an ankle by fastening means, said foot strap is affixed to said ankle strap, and, is fastened around a foot by fastening means, and a resistance is attached to said ring.

A door attachment point is also disclosed, which has a strap having a first loop at one end containing a ring held therein, the ring for attachment to a resistance band, a second loop containing a dowel at the opposite end, for placement behind a door, and a third loop positioned between the first and second loops, the third loop containing a stopper for resisting movement of the door attachment vertically within the door.

BRIEF DESCRIPTION OF THE DRAWINGS

It will now be convenient to describe the invention with particular reference to one embodiment of the present invention. It will be appreciated that the diagrams relate to one embodiment of the present invention only and are not to be taken as limiting the invention.

FIG. 1 is a front view of the multi-planar resistance band exercise system in a horizontal position, according to one embodiment of the present invention;

FIG. 2 is a rear view of the multi-planar resistance band exercise system in a horizontal position, according to one embodiment of the present invention;

DETAILED DESCRIPTION OF THE INVENTION

Figures 3, 4:
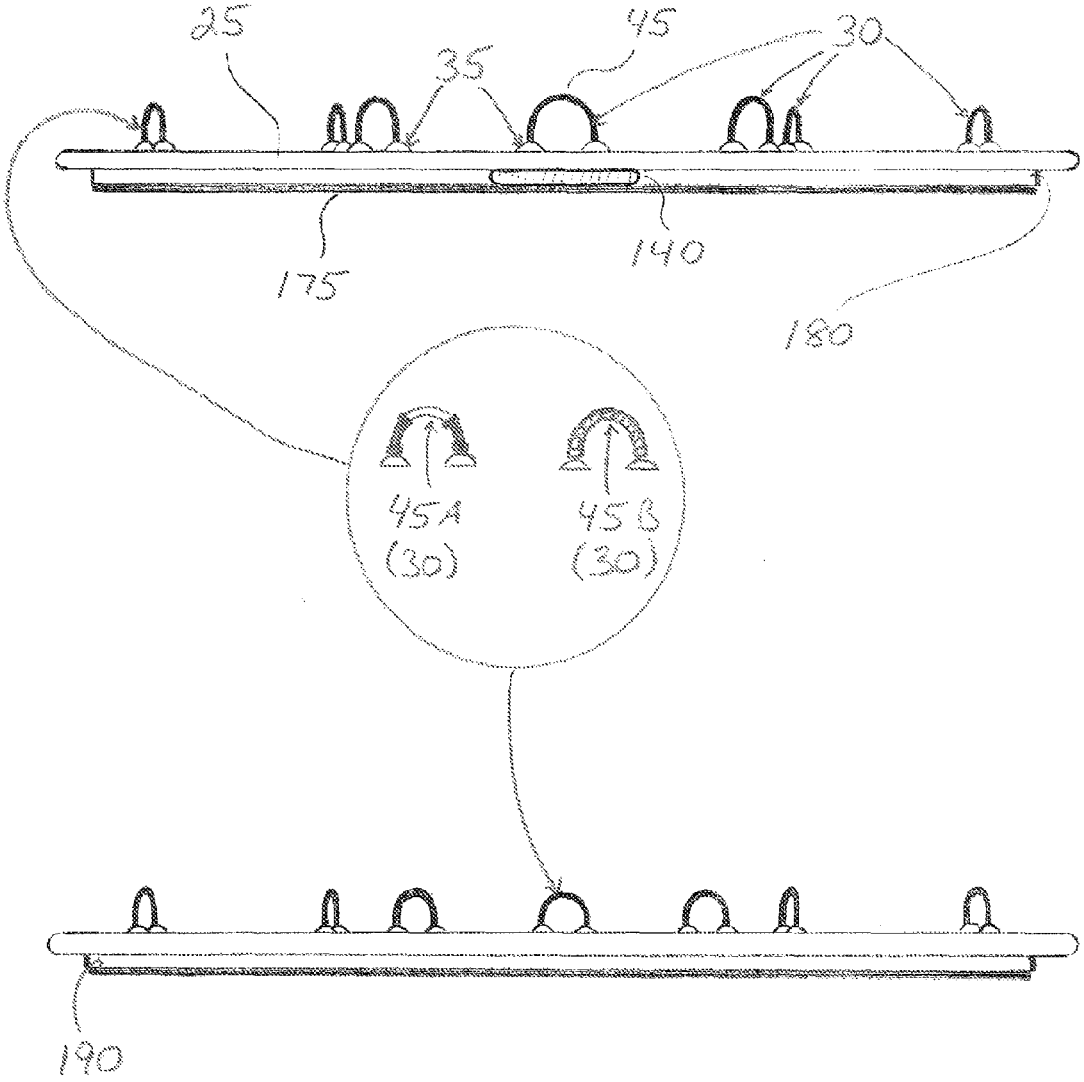
FIG. 3 is a top view of the multi-planar resistance band exercise system in a horizontal position, according to one embodiment of the present invention.
FIG. 4 is a bottom view of the multi-planar resistance band exercise system in a horizontal position, according to one embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

With reference to FIG. 1 and according to one embodiment of the present invention, the multi-planar resistance band exercise system consists of a rigid board 10 which forms the base of the system. In the preferred embodiment, the board 10 is manufactured of ¾" plywood, is approximately ¾" thick, and the face 20 measures approximately 2'×4'. A person skilled in the art would appreciate that the board may be made of a material other than plywood, such as plastic or fiberglass, and may be a different size or thickness, while still falling within the scope of the invention. The board has edges as follows: a top edge 70, bottom edge 170, left edge 150 and right edge 160.

The face 20 is covered in non-skid rubber, or another non-skid surface such as vinyl or plastic with a rough or mineral-coated surface, and the edges of the board 10 are covered in rubber or plastic bumpers 25 in order to protect the edges from impacts and reduce the possibility of causing damage to nearby objects when the board is moved and act as a durable non-skid surface when said board is in its upright position. The board 10 has a handle 140 on the top, which facilitates carrying the board 10 from one location to another.

With further reference to FIG. 1, the board 10 has affixed on its face 20 a plurality of attachment points 30, having a ring-like feature for attachment of a hook (not shown) or resistance bands (not shown), each consisting of a metal U-bolt 45 anchored through the board 10 and affixed at the back 40 (not shown) of the board 10 using countersunk hex nuts (not shown), and affixed at the front 20 of the board using hex nuts (not shown) which reside within a protective jacket 35 of rubber or plastic. The hex nuts (not shown) may be replaced by wing nuts or another quick-release bolt for ease of removal of the U-bolts 45. The attachment points may consist of an O-ring or a D-ring fastened through the board, instead of the U-bolt 45 described above. The attachment points 30 serve to anchor resistance bands (not shown) in the course of performing an exercise. Each attachment point 30 may be labeled by means of a number on the board 10, to aid in referring to particular attachment points in the course of a guided exercise program, such as a DVD. Letters may also be shown on the front 20 of the board, in locations strategic to performing certain exercises. This is helpful in guiding the user to place feet or hands are certain positions on the board in order to achieve a particular orientation. In a preferred embodiment, some of the plurality of attachment points 30 are arranged in a substantially semi-circular shape around the center 50 of the board, with a first upper attachment point 60, numbered on the surface of the board as #7,for reference located at 0° on the semi-circle, near the top edge 70 of the board 10. Second and third attachment points 80, 90, respectively numbered on the surface of the board as #6and #5are placed at 45° and 315° respectively around the semi-circle relative to the top edge 70 at 0°. Fourth and fifth attachment points 100, 110, respectively numbered on the surface of the board as #4and #3,are placed at 90° and 270°, respectively, relative to the top edge 70 at 0°, on either side of the center 50. Sixth and seventh attachment points 120 and 130, respectively numbered on the surface of the board as #2 and #1, lie outside of the semi-circular shape, in the same orientation as fourth and fifth attachment points 100, 110, however are placed at the right and left sides 150, 160 of the board, still on either side of the center 50. The attachment points 30 may be movable from one point on the board to another, removable and rotatable without departing from the scope of the invention. In another embodiment, the attachment points 30 may be folded down when not in use so as to be flush with the surface of the board 10. The exposed portion of the U-bolt 45 of the attachment point may be coated in rubber so as not to scratch objects which come into contact with it. A metal or plastic sleeve may also be wrapped around the exposed portion of the U-bolt 45 in order to reduce the rotational friction around the exposed portion of the U-bolt 45 while a resistance band 320 (not shown) is passed through the exposed portion of the U-bolt 45 in the course of performing an exercise. In another embodiment, the board may have a plurality of holes (not shown) so that the attachment points 30 may be mounted in any position, and a person skilled in the art would appreciate that affixing the attachment points 30 to other locations on the board 10 not specified in the preferred embodiment is also within the scope of the invention. A foam pad 3 may be placed on the center 50 of the board 10, within the semicircle of attachments points 30, to reduce pressure on a user's body parts providing opposition against the board 10 in the course of performing exercises. One reason the attachment points 30 are placed in a semi-circular manner around the center 50 is to permit the placement of a Swiss ball on the center 50.

With reference to FIG. 2, and according to one embodiment of the present invention, the back 40 of the multi-planar resistance band exercise system is shown. An aluminum frame 205, composed of upper and lower aluminum frame members 210, 220 and brace 230, is pivotally mounted to the back of the board 10 at one side by a hinge 200, so that the opposite side of the frame 205 may pivot outwardly and enables the board to stand upright on its left side 150. Affixed along the top and bottom edges 70, 170 of the board 10 are upper and lower frame brackets 180, 190. Rubber strips 175 run along the length of the upper and lower frame brackets 180, 190 in order to reduce slipping when the board is placed horizontally on the floor, and provide a stabilizing runner while the board is balancing on a foam roller (not shown), for example. At one end of the board 10, in this embodiment the left side (when the board is viewed from the back) of each of the frame brackets 180, 190 a hinge 200 is affixed, to which is connected to upper and lower aluminum frame members 210, 220. The hinges 200 permit the upper and lower aluminum frame members to pivot outwards from the board. The upper and lower aluminum frame members 210, 220 pivot together because they are connected by means of a brace 230. The movement of the aluminum frame members 210, 220 is restricted and supported by means of upper and lower frame folding mechanisms 240, 250, positioned at approximately the midpoint between the left side and the right side of the aluminum frame members 210, 220 which permits aluminum frame members 210, 220 to pivot outwards a certain distance to maintain a three-footed stance, the first and second feet consisting of the two bottom feet 215, 225 of the aluminum frame members and the third foot consisting of the left edge 150 of the board 10, at which point the frame folding mechanisms 240, 250 may be locked into position. When not in use, the aluminum frame members 210, 220 are folded inside the upper and lower frame brackets 180, 190, and brace 230 is snapped to the back 40 by means of plastic C-clips 260. A fabric loop may be attached to the brace 230 to facilitate pulling the aluminum frame members 210, 220 and brace 230 from the C-clips 260. The back 40 of the board also has affixed to it four rollers 231 which facilitate relocating the board from place to place, and provide stabilizing points when the board is balancing on the foam roller, for instance, to help the board to keep sliding. A person skilled in the art would appreciate that the frame members may be made of materials other than aluminum, while still falling within the scope of the invention.

With reference to FIG. 3, and according to one embodiment of the present invention, a top view of the multi-planar resistance band exercise system is shown. A rubber bumper 25 surrounds the edges of the board. From this top view, the profile of the attachment points 30 in the form of a U-bolt 45 may plainly be seen, as well as that of the protective rubber jacket 35. On the top of the board 10 is affixed a carrying handle 140. Upper frame bracket 180 and rubber strip 175 are plainly visible in this view. Two sample variations of U-bolt 45 with anti-friction sleeves are shown in inset 45A and 45B; a person skilled in the art will realize that there are many means to provide anti-friction on the attachment points 30 and despite variation of means will remain within the scope of the invention.

With reference to FIG. 4, and according to one embodiment of the present invention, a bottom view of the multi-planar resistance band exercise system is shown. Lower frame bracket 190 is plainly visible in this view.

Figures 5, 6:
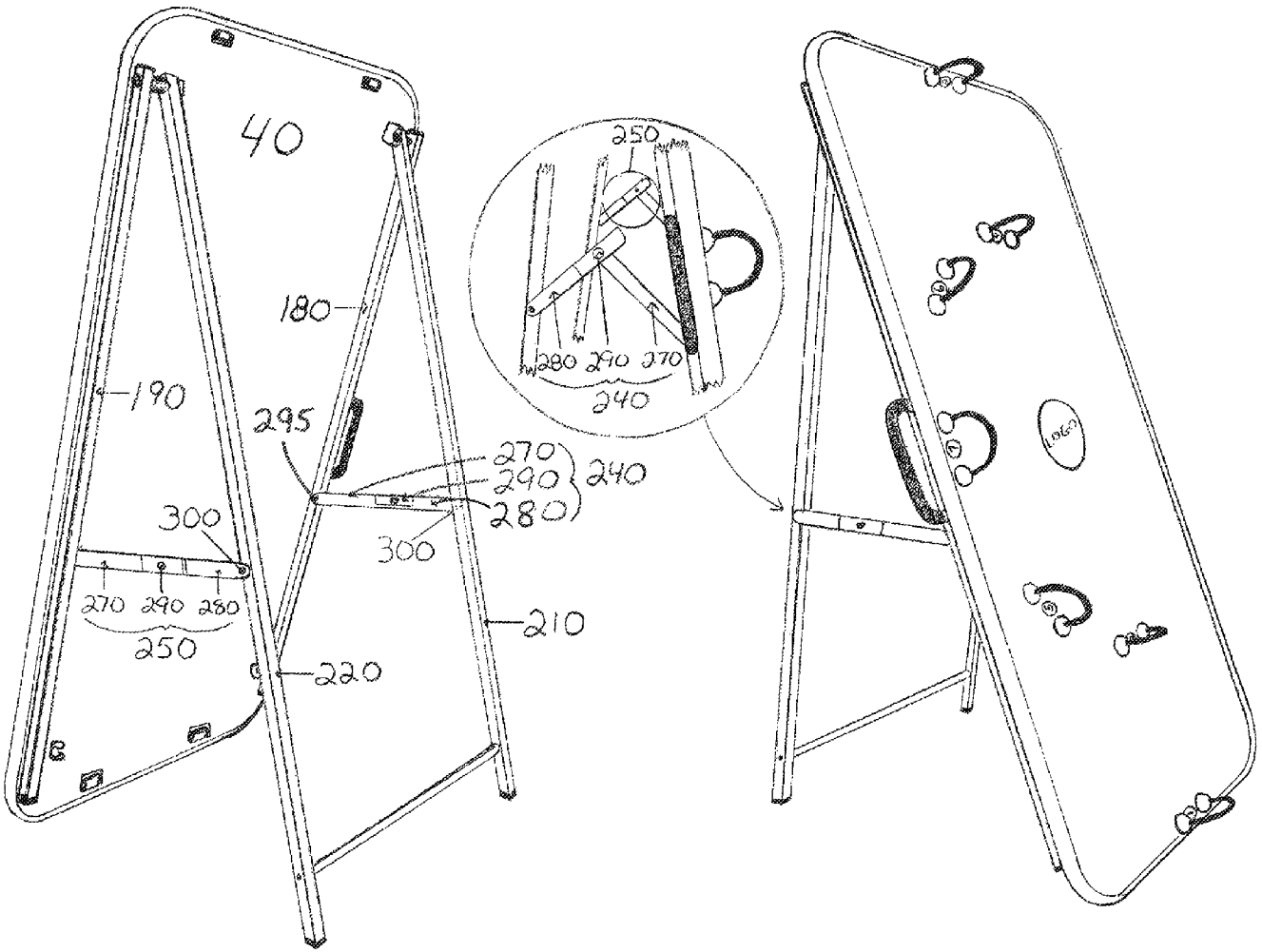
FIG. 5 is a rear perspective view of the multi-planar resistance band exercise system in an upright position, according to one embodiment of the present invention.
FIG. 6 is a front perspective view of the multi-planar resistance band exercise system in an upright position, according to one embodiment of the present invention.

With reference to FIG. 5, and according to one embodiment of the present invention, a rear view of the multi-planar resistance band exercise system in an upright position is shown. The upper frame folding mechanism 240 consists of a first and second support members 270, 280 connected to each other by means of a hinge 290, the first support member 270 also connected by means of a hinge 295 to frame bracket 180, the second support member 280 also connected by means of a hinge 300 to corresponding aluminum frame 210. A lower frame folding mechanism 250 is also present between the lower frame bracket 190 and lower aluminum frame member 220, and functions in an identical manner to the upper frame folding mechanism 240. The frame folding mechanisms 240, 250 operate in the same manner as a stepladder, that is, they permit the aluminum frame members 210, 220 to pivot a sufficient distance from the back 40 to form a stable three-footed stance as discussed above, at which point the frame folding mechanisms 240, 250 may be locked into position. Once locked, the frame folding mechanisms 240, 250 do not release involuntarily, and maintain the stability of the three-footed stance.

With reference to FIG. 6, and according to one embodiment of the present invention, a front view of the multi-planar resistance band exercise system in an upright position is shown. The inset drawing shows how the upper frame folding mechanism 240 is unfolded. Pushing on hinge 290 from below causes the hinge to fold up, and frame bracket 180 may then be brought together with its corresponding aluminum frame 210.

Figure 7:
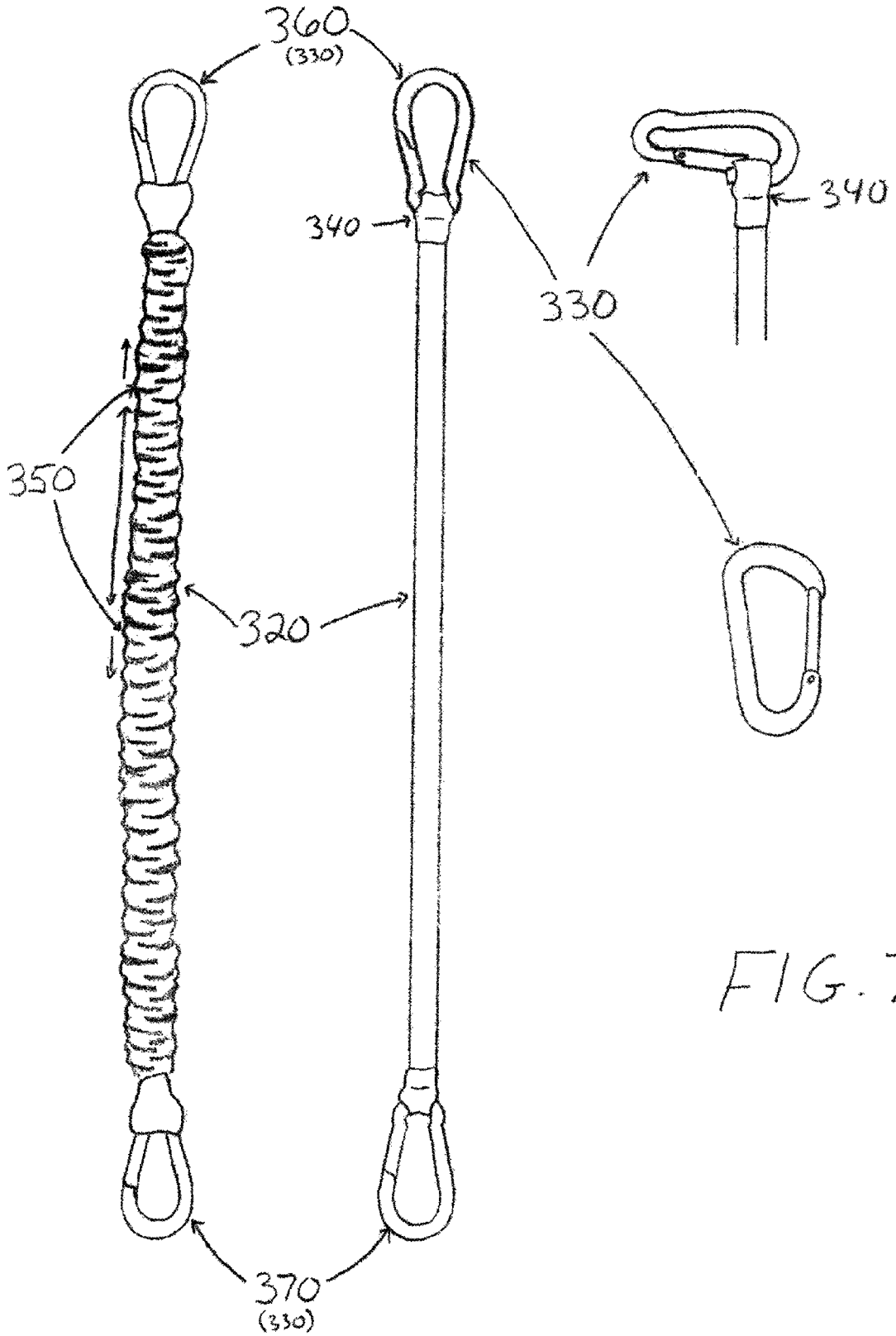
FIG. 7 is a detail view of a resistance band for the multi-planar resistance band exercise system, according to one embodiment of the present invention.

With reference to FIG. 7 and according to one embodiment of the present invention, a view of the resistance bands 320 of the multi-planar resistance band exercise system are shown. The resistance bands are formed of a length of elastic tubing of varying elasticity and therefore resistance, and are color-coded to indicate resistance level. Resistance bands of the same color may be doubled in order to double the resistance. A variety of resistance bands may be used together to customize resistance. Hooks 330 such as a snap hooks, which enable easy and secure connection to the attachment points 30, are affixed to each end of the resistance band tubing by means of a knot 340 in the elastic tubing, which knot is secure and does not release under tension. A person skilled in the art would be able to appreciate that there are many ways in which the hook 330 may be affixed to a resistance band 320 without danger of the hook 330 separating from the resistance band 320 under tension. A person skilled in the art would also appreciate that while snap hooks are a preferable hook, there are other hooks that would provide adequate performance and could be substituted without deviating from the scope of the invention. The elastic tubing is covered in a sleeve 350 manufactured from nylon or another static material, which prevents the elastic tubing from being stretched beyond its limits, as well as containing the elastic tubing in the event of tubing breakage. The sleeve 350 also reduces sliding friction when the resistance bands 320 are passed through the attachment points 30, and slide within the U-bolt 45. The hook 360 at a first end of the resistance band 320 is clipped to an attachment point 30 on the board 10, which attachment point 30 is desired for use as a position for an exercise. The hook 370 at a second end of the resistance band 320 is then clipped into a body attachment fastener, which the user may pull or push in order to provide resistance for muscle movement. A person skilled in the art would appreciate that the words "elastic tubing" also encompass metal springs, friction spools, hydraulic pistons or other elastic, resistant materials or constructions, any of which may be used for the constructions of resistance bands 320 while not departing from the scope of the invention.

Figure 8:
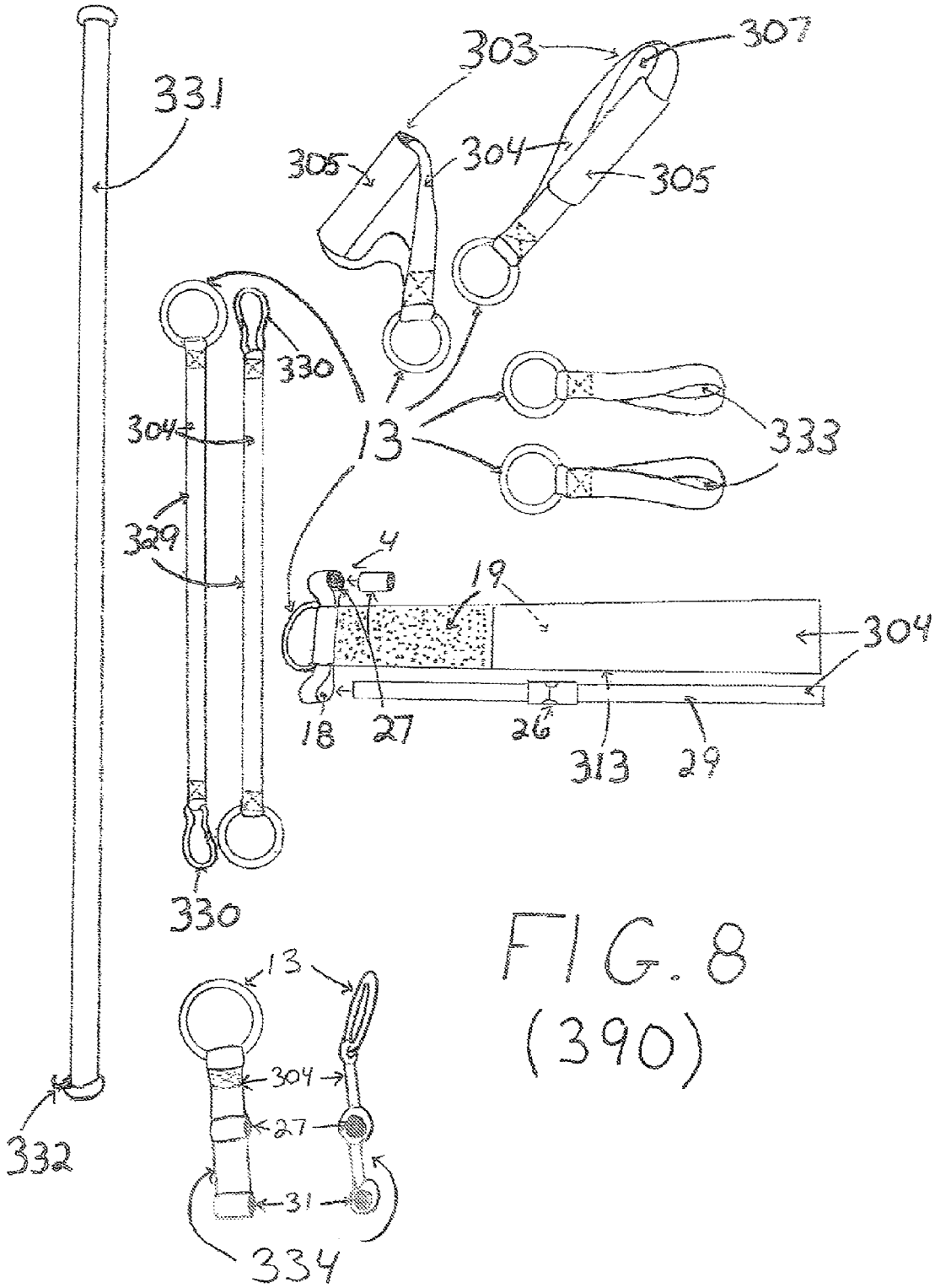
FIG. 8 is a detail view of the handles and accessories for the multi-planar resistance band exercise system, according to one embodiment of the present invention.
Figure 11:
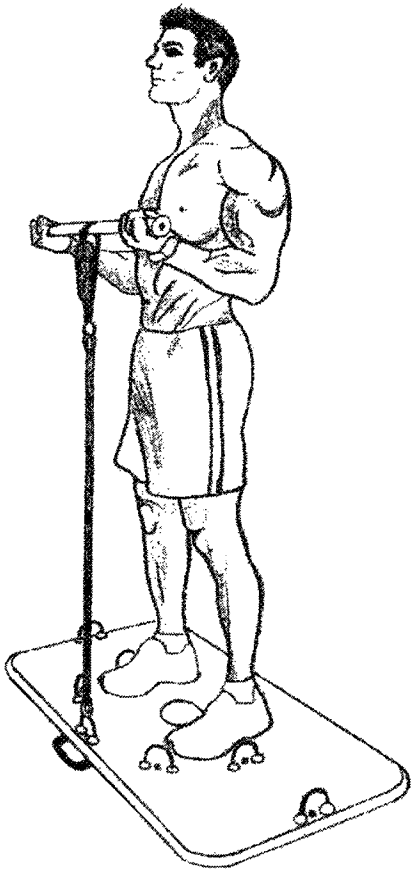
FIG. 11 is a view of the multi-planar resistance band exercise system in use in a horizontal position, according to one embodiment of the present invention.
Figure 10:
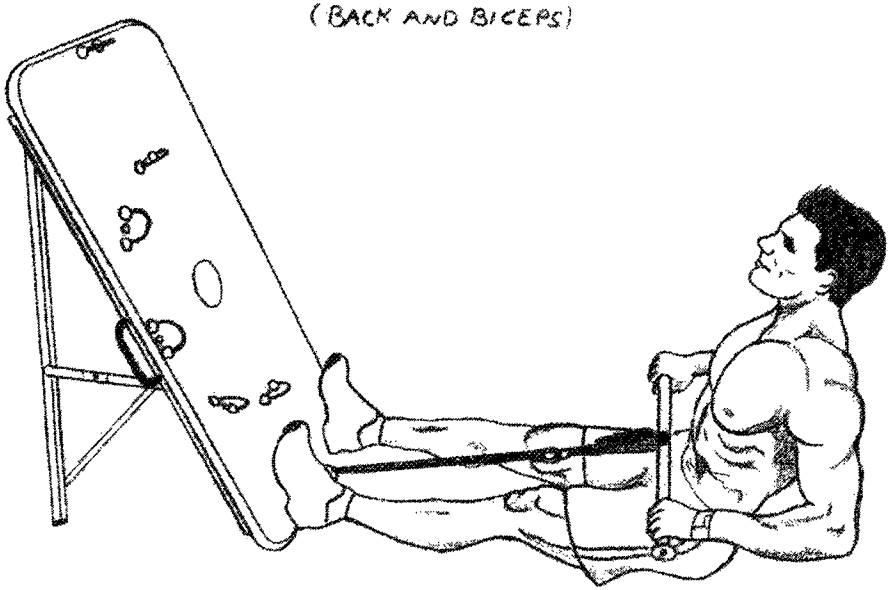
FIG. 10 is a view of multi-planar resistance band exercise system in use in an upright position, according to one embodiment of the present invention.

With reference to FIG. 8, and according to one embodiment of the present invention, a view of the body attachment fasteners, and door attachment of the multi-planar resistance band exercise system in an upright position are shown. Various types of body attachment fasteners 390 in addition to handles 303, which are a specific type of fastener, are available for attachment to the other end of the resistance band, such as ankle or wrist straps 313, or a cylindrical bar 331 which reproduces the movement of a traditional barbell. The body attachment fasteners 390 permit attachment to parts of a person, such as extremities, limbs or the midsection, for example. The handles 303 are meant to be grasped by the hands and pulled or pushed by the arms and body, while the board 10 is held in a stable position by the user's full or partial body weight, for example, opposition by the feet standing on the board 10, as shown in FIG. 11, or the feet pushing against the board 10 in an upright position, as shown in FIG. 10. The ankle straps 313 are meant to be strapped around an ankle, so that the ankle can be moved away from the body and subjected to resistance from the band, while the board is held fast by opposition, as mentioned previously. The cylindrical bar 331, made of hardwood with a rubber or plastic coating may be used by passing a nylon loop 333 around its circumference and positioning it in the middle of the bar 331, as shown in FIG. 10, such that the pull is even on both sides where the user's hands are placed. It is attached to a person by means of being held by the hands. Alternatively, two nylon loops 333 connected to resistance bands may be looped around either end of the bar, such that the pull is even on both sides of the bar. The bar has a hook 332 at one end to be used in conjunction with the board's wheels 231 to pull the system around and lift the board up to reduce bending of the user's back. The handle 303 is made of nylon webbing 304 partially surrounded by slidable aluminum tubing 305 surrounded by foam padding, which webbing is sewn into a loop, where it is grasped by the user's hand, along with a metal O-ring 13 sewn into the nylon webbing opposite the aluminum handle 305, which O-ring 13 may be clipped to the resistance bands 320. The handles 303 may also serve as nylon loops for the bar 307, if the aluminum tubing 305 may be pushed to one side. The usable length of the resistance bands 320 may also be extended for taller users or for longer-stretching exercises by means of ring extension straps 329, which comprise a nylon strap 304, with a metal O-ring 13 affixed at one end and a hook 330 affixed at the other end. In order to use the extension strap 329, the hook 330 may be snapped to an attachment point 30, and one or more resistance bands 320 may be attached to the O-ring 13 at the other end of the nylon webbing 304, instead of at an attachment point, thereby permitting the extension of the resistance band in an exercise to begin at a point a certain distance from the attachment point 30. The effective length of the extension strap 329 may be varied by hooking the hook 330 onto an attachment point 30, then passing the O-ring 13 through a second attachment point 30, such that the nylon webbing now bends around the second attachment point 30, and the extension strap appears to be anchored from the second attachment point 30. The extension strap 329 is used by shown in use in FIG. 12.

A door attachment point 334 is also shown in FIG. 8, and this is intended to be placed between a closed door and its frame, so as to be mounted within the door. This can act as an additional door attachment point 334 that is not on the board 10, to facilitate multi-dimensional exercises where a door attachment point 334 above the board 10 is required, without having to place the board 10 in an upright position. Each door attachment is comprised of a material strap 304 preferably made of nylon, the strap having a first loop containing a ring 13, for example and O-ring or D-ring, sewn in or held at one end. The ring 13 is for attachment to a resistance band 320 which may attached thereto, and the door attachment point further has a second loop 31 containing a wood or plastic dowel sewn in at the opposite end to that having the ring 13, the loop 31 containing dowel to be placed behind a door. In the center of the door attachment is a sewn-in third loop containing a rubber stopper 27, which stopper 27 acts as a brake to resist movement of the door attachment vertically along the door frame, while under load during exercises for example. This is most useful in the course of exercises which exert a downward force on the door attachments, such as a triceps push down. The door attachments are used in conjunction with the rubber bands 320 and body attachments 390 whereby the user may perform exercises that require a higher attachment point than is available on the board 10. To use the door attachment a person opens a door (not shown), inserts the portion of the nylon strap 304 located between the wood dowel 31 and the rubber stopper 27 against the door frame (not shown), and closes the door, and engages the latch, so that the nylon strap 304 is trapped between the door and frame. The O-ring 13 should be oriented towards the user to be available as an attachment point, and a rubber band 320 may be attached to the O-ring 13. A person skilled in the art would recognize that materials for the board, resistance bands and body attachment fasteners may be substituted, varying the material properties of the parts, while remaining within the scope of the invention.

Figure 9:
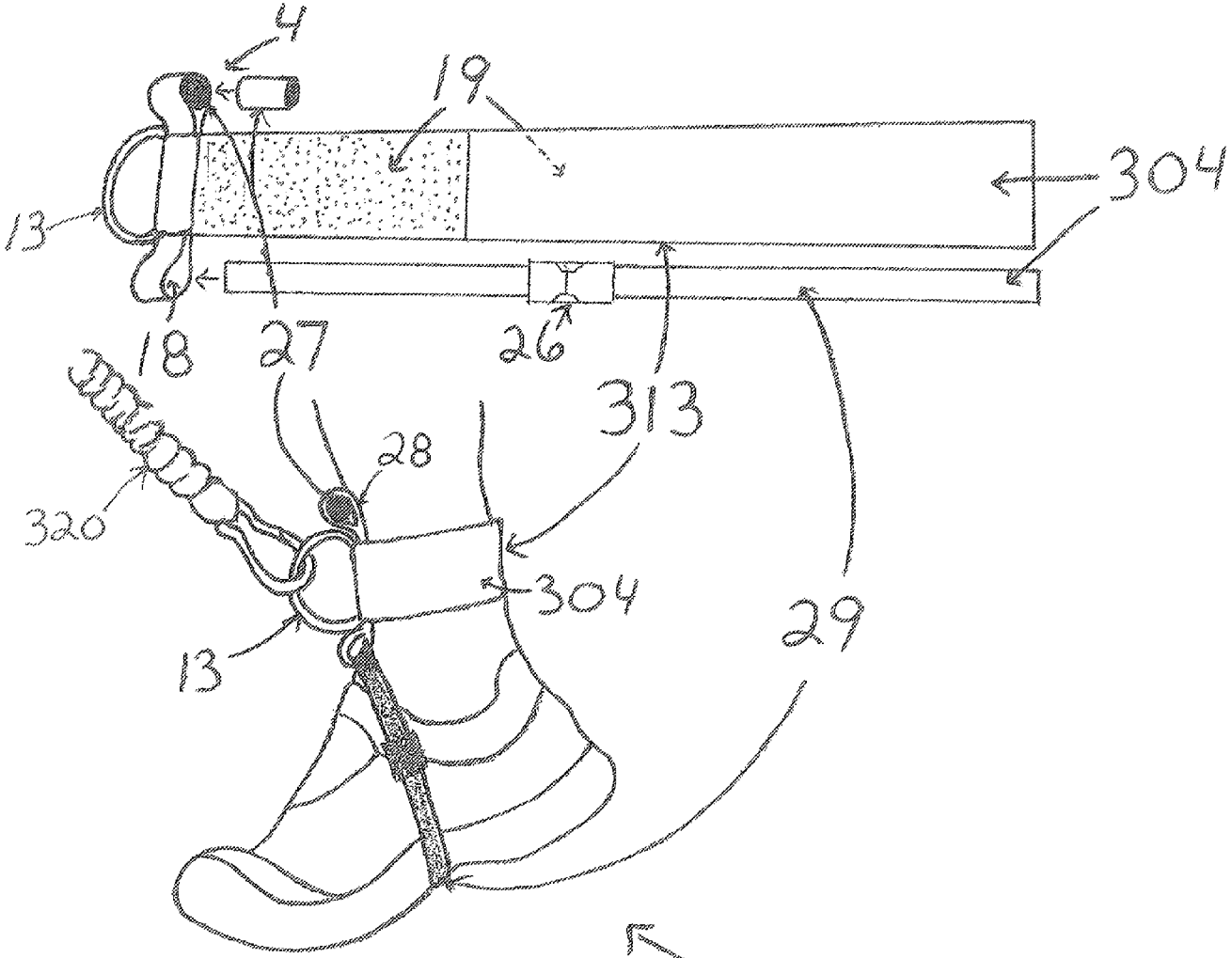
FIG. 9 is a detail view of the ankle strap for the multi-planar resistance band exercise system, according to one embodiment of the present invention.

With reference to FIG. 9, the ankle strap 313 is made of a piece of webbing such as nylon webbing well-known in the art, for example Cordura™, using a fastening means 19 such hook and loop fasteners (Velcro™) to attach the ankle strap 313 to itself as it is wrapped around the user's ankles, with a metal ring, in the preferred embodiment an O-ring 13, sewn perpendicular to the orientation of the webbing 304, into a loop in the nylon webbing 304, as an attachment point for one or more resistance bands 320. One skilled in the art would appreciate that the metal ring may comprise an O-ring or a D-ring, or any other type of metal fastening ring. Across the junction of the nylon webbing 304 with the O-ring 13, is sewn a strip of nylon which is sewn into an upper loop 4 and a lower loop 18. The upper loop 4, filled with a cylindrical rubber bumper 27, is sewn in on either end of the O-ring 13 as a bumper to cushion a user's shin 28 from the impact of the O-ring 13. A lower loop 18 is used to pass a foot strap 29 through, which foot strap is made from a section of nylon webbing 304 or other material, which may be tied to itself, so as to form a loop, using fastening means such as a clip 26, or any other fastening means for affixing material to itself, such as a knot, or hook and loop fasteners. The foot strap 29 prevents the ankle strap 313 from "riding up" the ankle or causing discomfort from the ring 13 pressing into the ankle, when the foot is being pushed away from the resistance band 320, and so keeps it in close proximity to the foot. The upper loop 4 rubber bumper 27 prevents discomfort on the shin in the same circumstance.

With reference to FIG. 10, and according to one embodiment of the present invention, the user is shown using the multi-planar resistance band exercise system in an upright position. First the board 10 must be placed in an A-frame three-footed stance discussed above by means of extending the aluminum frame members 210, 220 from the board 10. The exercise system is assembled by connecting a first end of one or more resistance bands to one or more attachment points, and connecting a second end of said resistance bands to one or more body attachment fasteners. The user then stabilizes the position of the board by means of opposition, which entails that he uses his body to push the board in one direction while applying force, for example pulling on the body attachment fasteners in the opposite direction. For instance, the individual in FIG. 10 is pulling on the short bar handle in a rowing position, while, simultaneously pushing the board with his feet. The action of pulling on the body attachment fasteners creates the exercise for the muscles, and thereby provides a benefit for the user, in the case of this exercise for the biceps and back. The upright position of the board facilitates a variety of exercises, including many for the back and shoulder, pulling away from the board while stabilizing it with the feet.

With reference to FIG. 11, and according to one embodiment of the present invention, the user is shown using the multi-planar resistance band exercise system in a horizontal position. The exercise system is assembled by connecting a first end of one or more resistance bands to one or more attachment points, and connecting a second end of said resistance bands to one or more body attachment fasteners. The user then stabilizes the position of the board by means of opposition, in this case by standing on the board 10. The action of pulling on the body attachment fasteners in a direction away from the board 10 creates the exercise for the muscles, and thereby provides a benefit for the user. For instance, as is shown in FIG. 11, an individual stands on the board, holding it immobile by the force of his weight, simultaneously pulling up on the bar handle, which is in turn connected to the board through the resistance band. This is a curl motion and benefits the shoulders as well as the arm muscles.

Figure 12:
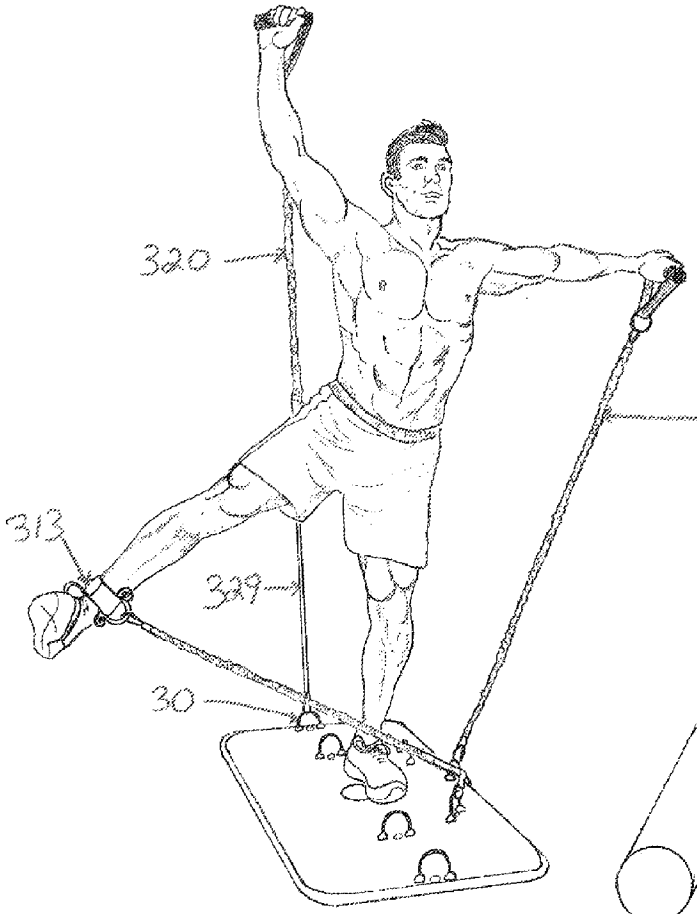
FIG. 12 is a view of multi-planar resistance band exercise system in use in the course of a multi-planar exercise, according to one embodiment of the present invention.

With reference to FIG. 12, and according to one embodiment of the present invention, the multi-planar resistance band exercise system may be used to execute exercises in a variety of unconventional ways, for example permitting multi-planar exercises, meaning that various limbs may be worked in several planes simultaneously. For example, a user may stand on the board, with an ankle strap around his ankle, and handles in each hand, all attached to the board by means of resistance straps. One leg will be used as support for the body and stability for the board by standing on the board. The leg with the ankle strap may be moved out from the other leg repeatedly, while one hand pushes up and another pushes out in a direction at right angles to the plane of the leg with the ankle strap. In this way, the exercise system permits a multi-planar workout. In this figure, the extension strap 329 is shown in use, providing the user with the means to perform a high overhead press with a single resistance band 320. The upper portion of the resistance band 320 is attached to the handle 303 and the lower end of the band is attached to the O-ring 113 (in this drawing hidden behind user's leg) of the extension strap 329, with the lower end of the extension strap 329 fastened to the attachment point 30 by means of hook 330.

Figure 13:
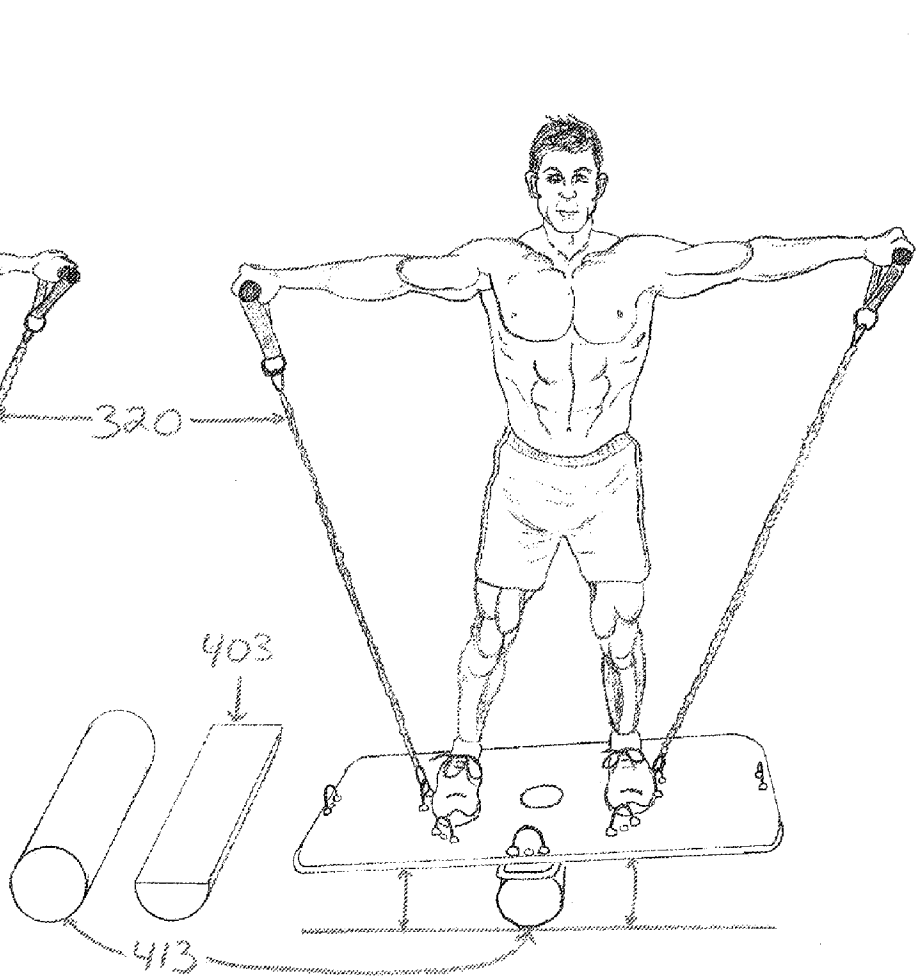
FIG. 13 is a view of multi-planar resistance band exercise system in use on a balance element, according to one embodiment of the present invention.

With reference to FIG. 13, and according to one embodiment of the present invention, the board may be placed on a high-density foam cylinder or half-cylinder to provide a rocking and sliding action as the user exercises on the now-unstable board, unbalancing the user and forcing him to use stabilizer muscles to keep himself in balance. Resistance bands may be added to increase difficulty level, as shown by the user performing a shoulder side raise while balancing on the foam cylinder 413, as shown in FIG. 13. In addition, a vibration unit may be affixed to the board to provide minute vibration, which unsettles the muscle and provides a more complete workout, building muscle mass, raising bone density, and speeding recovery.

Figure 14:
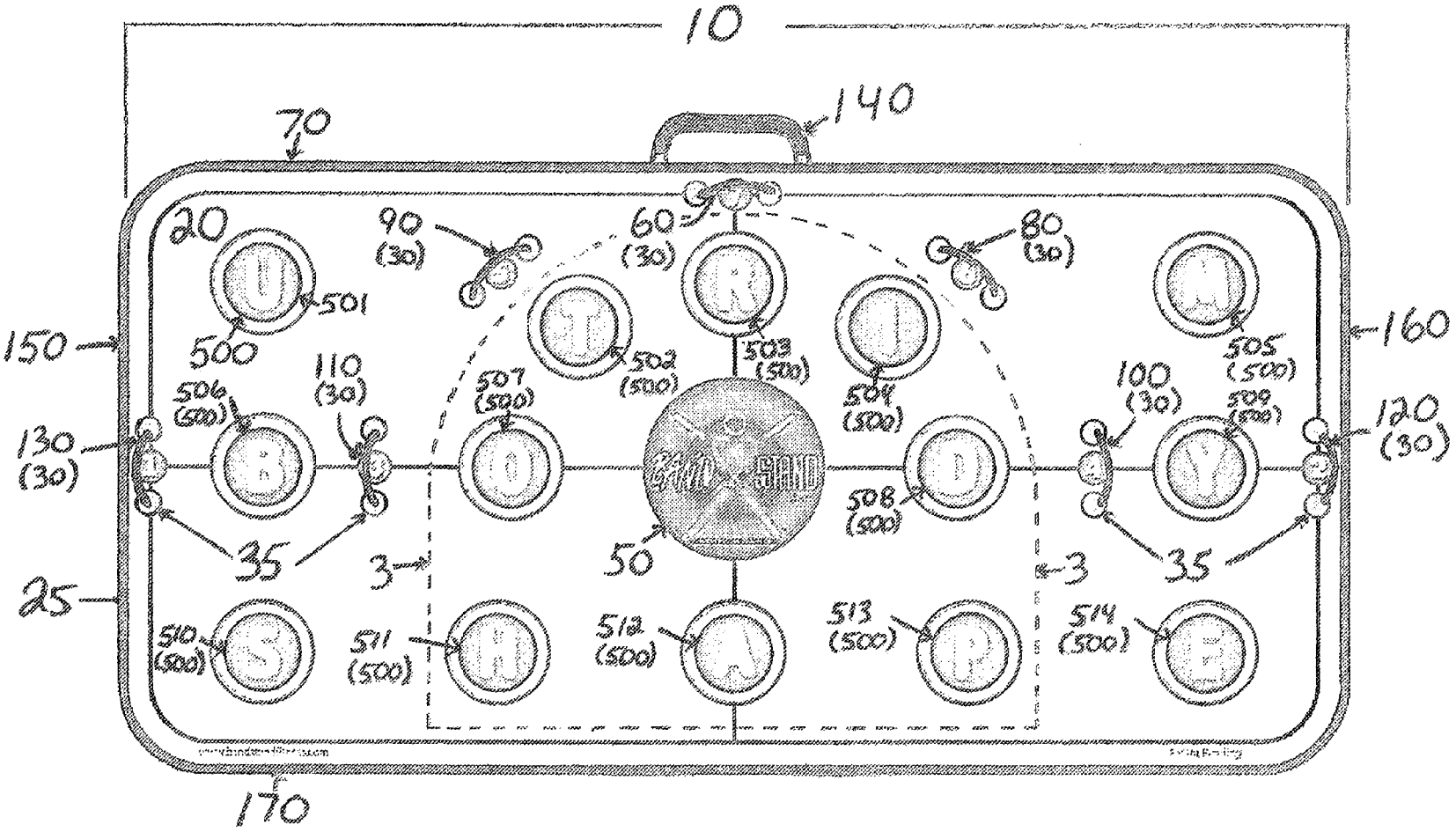
FIG. 14 is an example of foot, hand and body position labeling on the top of the board.

With reference to FIG. 14, an example of the board surface is shown. Each attachment point 30 may be labeled by means of a number on the board 10, to aid in referring to particular attachment points in the course of a guided exercise program, such as a DVD. Letters may also be shown on the front 20 of the board, in locations strategic to performing certain exercises. This is helpful in guiding the user to place feet or hands are certain positions on the board in order to achieve a particular orientation. In this example, the attachment point, foot, hand and body locations are labeled with letters, specific letters and placements are shown however a person skilled in the art would appreciate that any type of lettering, labeling, pattern or placement of the foot/hand/body locators will help the user to use the device to its full potential and any variation in the markings still falls within the scope of the invention. In this preferred embodiment starting from top left 70/150 of board 10 and reading left to right is the letter U (501), moving right is the letter T (502) which sits between center 50 and attachment 90, to the right of that is letter R (503) which sits between center 50 and attachment point 60, moving right is letter I (504) which is situated between center 50 and attachment point 80, on the far top, right side is letter M (505), below M (505) is letter Y (509) and it sits horizontally between attachment points 100 and 120, over and left of attachment point 100 is letter D (508) and it sits between center 50 and attachment point 100, moving left of center 50 and centered between attachment point 110 and center 50 is letter O (507), moving left and centered between attachment points 110 and 130 is letter B (506). Moving down to the bottom left corner 25/170 is letter S (510), right of that and centered between 510 and 512 is letter H (511), moving right again is letter A (512) which sits centered between 511 and 513 and is on the bottom vertical center line of board 10, right of that and centered between 512 and 514 is letter P (513), and finally on bottom right of 170/160 is letter E (514).

A large exercise ball (approximately 35 to 85 cm in diameter, sometimes referred to as a Swiss Ball) may be placed within the semicircle of attachment points referred to in the description of FIG. 1, on the centre 50, and it may be used to provide a balance element for exercises the user is performing, or it may be used as a support to facilitate exercises such as a resistance band chest presses, resistance band flys, preacher curls or sit-ups using resistance.

In a gym one or more of the boards may be fixed permanently to the floor in a horizontal position, or against the wall in an upright position, so that the user does not need to provide oppositional forces against the board, such as standing on the board, to provide stability for the exercise system.

The board may have any number and type of electronic monitors mounted within it, for example a heart rate monitor, which presents the user at all times with his heart rate as he is exercising. Alternatively, a clock may be mounted in the board in order to provide information on the time elapsed or provide a noise as a signal to commence on a new exercise. A calorie counter may also be mounted in the board. A telescoping bar rack may be fastened to the edge of the board to hold the bar in between sets of the user's workout.

The following are descriptions of a representative sample of possible exercises on the multi-planar resistance band exercise system. Included are exercises that work the major muscles groups including the legs, chest, back, shoulders, biceps and triceps. An in-depth user guide book with photos and exercise descriptions may be used with the system to inform users as to the possible exercises. Also, a DVD or interactive program may be used with the system in order to tailor an exercise program to a particular goal, introduce new exercises, and provide a routine to follow with an on-screen guide.

Legs

1) Squat: Place board flat on the ground then attach one end of one or more resistance band(s) to attachment 110(3) and the other end(s) to an "O" ring attachment strap, then attach a second set of the exact same amount of resistance band(s) to attachment point 100(4) and the other end(s) to an "O" ring attachment strap, you should now have equal amounts of resistance tubing attached on either side of the centre of the board, now feed the long bar through both straps. Stand on the centre of the board with feet shoulder width apart then crouch down and place the bar behind your neck on soft flesh of shoulders, align body and back and stand straight up, repeat up down body motion till desired fatigue is met, usually 5-15 repetitions depending on goal.

2) Hamstring Curl (single leg): Place board in upright "A" frame position, board hook 1 is near floor.

(a) Attach one end of one or more resistance band(s) to attachment point 110(3) and feed band(s) down through attachment point 130(1) then attach ankle strap to other end of resistance band(s) preferably after ankle strap is fixed around user's ankle. Stand facing the board with hands on top edge of board for support and non-exercising foot against bottom of board to stabilize it, shift body weight onto non-exercising leg and curl (bend knee) exercising leg in a backwards motion (knee flexion) driving the heel back and up towards buttocks, repeat motion until desired repetitions are completed.

(b) Switch exercising leg and repeat said function.

Note: The above hamstring exercise can be quickly changed into a gluteus exercise by setting up exactly the same way except the exercising leg kicks straight back with no bend in the knee thus activating the gluteus muscles to move the resistance. This is one of many examples where a different exercise can be setup quickly to work another muscle. A user with the right knowledge or instruction can go back and forth between different exercises or string together a group of different exercises aimed at different muscle groups in order to work the body and its energy system on a more full range, this can be very effective for fitness and overall health.

Chest

1) Flat Press—Place board flat on the ground then attach one end of one or more resistance band(s) to attachment point 130(1) and the other end(s) to an single hand handle strap, then attach a second set of the exact same amount of resistance band(s) to attachment point 120(2) and the other end(s) to a single hand handle strap, you should now have equal amounts of resistance tubing attached on each end of the board. Place exercise ball (included) in centre of board and position yourself with your shoulders on the ball and feet on the ground forming a plank position with your back parallel to the floor, grasp a handle in each hand and starting with your arms at a right angle press upwards until arms are straight and hands are almost together, repeat this motion for desired repetitions.

2) Incline Press—follow exact setup instructions as flat press with the adjustment of lowering your buttocks down thus changing the angle of your body, this movement will now focus more on working the upper chest.

3) Pectoral Flies—These can be performed in the flat body position or incline body position, set up is the same as both previous exercises with the adjustment of your arms are now straight out parallel with the floor instead of at right angles and remain straight throughout the movement of pulling your hands towards each other above your chest, repeat this chest squeezing motion for desired reps.

Back

1) Seated Row (see FIG. 10)—Place board in upright "A" frame position, sit on floor facing the board with your legs extended out straight so your feet are flat against the base of the board with a foot on either side of board hook 1, attach one or more resistance bands to an "O" ring strap then feed the band(s) through board hook 1 and then the other ends back to the "O" ring strap, the band(s) are now half there length. Slide the long bar through the strap of the "O" ring strap and grasp the bar with both hands about shoulder width apart, start movement with arms straight and pull bar towards stomach, repeat movement or desired repetitions.

a) This exercise may be performed with hands in a supinated position (palms up) or a pronated position (palms down) to work the back muscles at slightly different angles, promoting progressive muscle strengthening.

b) This exercise may also be performed using two single hand handle straps one in each hand instead of the long bar, resistance band(s) must be attached to each handle separately using the same looping as mentioned above. With this method the user can pull the hands towards the body while spreading the hands so once again activating new muscle fiber. This method also allows the user to perform the movement in a 3rd hand position, the "thumbs up" hand position. Every different hand position and angle of the movement encourages positive results.

2) Rear Fly—Place board flat on the ground then attach one end of one or more resistance band(s) to attachment point 130(1) and the other end(s) to a single hand handle strap, then attach a second set of the exact same amount of resistance band(s) to attachment point 120(2) and the other end(s) to a single hand handle strap, you should now have equal amounts of resistance tubing attached on both ends of the board. Stand on board with a wide legged stance and bend over with a straight back until your upper body is almost parallel to the floor, grab the left side handle with your right hand and the right side handle with your left hand so that the resistance band(s) are crisscrossing each other in front of you, start with your arms almost together hanging directly below you, while keeping your arms straight start to move them outwards in an arching motion till they are level with your shoulders then return them down till they hang under your body, continue this side up down motion for desired repetitions.

Shoulders

1) Overhead Shoulder Press—Place board flat on the ground then attach one end of one or more resistance band(s) to attachment point 130(1) and the other end(s) to an "O" ring attachment strap, then attach a second set of the exact same amount of resistance band(s) to attachment point 120(2) and the other end(s) to an "O" ring attachment strap, you should now have equal amounts of resistance tubing attached on each end of the board, now feed the long bar through both straps. Place the (included) foam padding down in the centre of the board and kneel on it keeping your back straight back straight, grab each end of the bar a bit wider than shoulders width apart and bring bar up to a starting point of eye level so that your arms are close to a right angle, then press the bar up over your head until arms are straight then lower bar back down in front of head till arms are at eye level or at a right angle. Repeat this pressing motion up then down for desired repetitions.

This exercise may also be performed by using the single handle attachment straps instead of the long bar attachments, this will allow you to press each hand up separately and in an alternating arm action if you choose, this type of exercise is great for high repetitions and getting the heart working harder.

2) Side Raises—Place board flat on the ground then attach one end of one or more resistance band(s) to attachment point 110(3) and the other end(s) to a single hand handle strap, then attach a second set of the exact same amount of resistance band(s) to attachment point 100(4) and the other end(s) to a single hand handle strap, stand in the centre of the board and grab a handle in each hand, keeping your arms straight raise your hands straight out to the sides and up until they are just above shoulder height then lower them back down to your side, repeat this side arm motion for desired repetitions.

(a) Front raises—These can be performed by setting up the exact same way as a side raise the only difference is that the movement of the arm is now coming straight up in front of the body and then back down instead of to the side. Each different angle the arm moves in an upward motion works the shoulder muscles through a greater range and thus more beneficial for positive results in functional strength.

Biceps

1) Long Bar Arm Curls (see FIG. 11)—Place board flat on the ground then attach one end of one or more resistance band(s) to attachment point 60(7) and the other end(s) to an "O" ring attachment strap, then feed the long bar through the strap until it's in the centre of the bar, stand on the centre of the board and grip the long bar with both hands about shoulders width apart, start with your arms straight down and keeping the upper part of the arm from the elbow to shoulder in a fixed position start to pull or curl the bar (elbow flexion) up to about shoulder height then lower back down till your arms are hanging straight again, repeat this curling up and down motion for desired repetitions.

2) Single arm curls—This exercise can also be performed single handedly or with an alternating arm action by attaching one end of one or more resistance band(s) to attachment point 110(3) and the other end(s) to a single hand handle strap, then attach a second set of the exact same amount of resistance band(s) to attachment point 100(4) and the other end(s) to a single hand handle strap, stand in the centre of the board and grab a handle in each hand, perform the same curling up motion as mentioned in the previous exercise only now you have the freedom to train each arm separately or on it's own, this allows you to perform and alternating arm curl action and also allows you to move your wrist into different positions while performing a curl and thus stimulating and activating a greater range of muscle fiber in the bicep and forearms.

Triceps

1) Single Arm Pushdowns—Place the board in it's "A" frame stand up position. Attach on end of one or more band(s) to attachment point 100(4) and feed the band(s) up through attachment point 120(2), now the band(s) should have half there length hanging out from the top of attachment point 120(2), now attach the other end(s) of the band(s) to a single hand handle strap. Kneel on your inside leg (which is the same side as the triceps you are exercising) facing the board and have your other leg bent with foot flat on the floor beside the board, this will give you stability while performing the exercise. Position your body so your exercising arm is directly in front of the resistance, grab hold of the handle with the hand of the triceps you want to exercise and starting point should be about shoulder height, keeping the upper part of your arm from the elbow to the shoulder in a fixed position push the handle down till your arm is straight, then raise it back up to shoulder height, repeat this pushing down motion for desired repetitions. Once finished working one arms triceps switch and perform exact same repetitions for the other arm to build an equal balance on each side of the body.

You can perform this same exercise with several different hand positions, i.e.: supinated (palms up), pronated (palms down) and side angle (thumbs up) to work different heads of the triceps muscles. These are great exercises to strengthen and add size to the triceps muscles in a full range.

2). Single. Arm Pushbacks—Place board flat on the ground then attach one end of one or more resistance band(s) to attachment point 60(7) and the other end(s) to a single hand handle strap. Stand sideways and back a bit from the attachment point so that the resistance band(s) are on the side of the triceps you are exercising and out in front of you. Bend slightly over with a flat back and put your opposite hand on your outside knee to support your body, then grab the handle attached to the resistance in your other hand, start with your hand at the side of your body and keeping the upper part of your arm from the elbow to the shoulder in a fixed position parallel to the floor (arm is at a right angle) push your hand straight back till your arm is fully extended then bend at the elbow and return your hand back to a right angle at your side. Repeat this pushing back motion for desired repetitions. When finished one arm switch your body position around and perform exact same exercise on your other triceps/arm.

The above comprises a representative sample of the primary exercise movements that may be performed on the Bandstand Fitness Board. One schooled in the art of exercise variations will fully appreciate and understand the vast capabilities that are available with this system, and would be able to perform a wide range of free motion exercises which would enable them to devise and apply multiple exercise routines that can strengthen, shape and rehabilitate both internal and visible muscle.

Many modifications and other embodiments of the invention will come to the mind of a person skilled in the art having the benefit of the teachings presented in the foregoing description and associated drawings. Therefore, it is understood that the invention is not to be limited to the specific embodiment disclosed, and that modifications and embodiments are intended to be included within the scope of the appended claims.

I claim:

1. A portable free-motion exercise system for strengthening and rehabilitating muscles and organs, comprising:

a) a rigid board having a non-slip surface;

b) a plurality of attachment points on a face of said board, each attachment point having a ring-like feature for attachment of a hook, each attachment point affixed to the face of said board;

c) at least one body attachment fastener for attachment to a part of a person; and d) one or more resistance bands, each resistance band comprised of a length of resistive elastic tubing having affixed at a first end a hook and an opposite end a hook, wherein each of the one or more resistance bands is detachably connected to an attachment point by means of connecting a hook at the first end to the attachment point, and the hook at the opposite end to a body attachment fastener.

2. The exercise system of claim 1, wherein the attachment points are movable between different positions on the board.

3. The exercise system of claim 1, wherein the attachment point is selected from the group consisting of a metal U-bolt, a metal D-ring and a metal O-ring.

4. The exercise system of claim 1, further comprising frame mounted to the back of the board, one side of said frame pivotally mounted to the board by hinges such that the opposite side may pivot outwardly from said board to enable the board to stand upright.

5. A portable free-motion exercise system for strengthening and rehabilitating muscles and organs, comprising:

a) a rigid board having a non-slip surface;

b) a plurality of attachment points on said board, each attachment point having a ring-like feature for attachment of a hook, each attachment point affixed to said board;

c) at least one body attachment fastener for attachment to a part of a person;

d) one or more resistance bands, each resistance band comprised of a length of resistive elastic tubing having affixed at a first end a hook and an opposite end a hook; and e) a frame mounted to the back of the board, one side of said frame pivotally mounted to the board by hinges such that the opposite side may pivot outwardly from said board to enable the board to stand upright, the frame comprising:

i) upper and lower frame brackets affixed along the top and bottom edges of the board; and ii) upper and lower frame members connected by a brace and restricted in movement away from the board by upper and lower frame folding mechanisms, wherein the upper frame member is pivotally attached at one end to the upper frame bracket, and the lower frame member is pivotally attached at one end to the lower frame bracket, and wherein each of the one or more resistance bands is detachably connected to an attachment point by means of connecting a hook at the first end to the attachment point, and the hook at the opposite end to a body attachment fastener.

6. A portable free-motion exercise system for strengthening and rehabilitating muscles and organs, comprising:

a) a rigid board having a non-slip surface;

b) a plurality of attachment points on said board, each attachment point having a ring-like feature for attachment of a hook, each attachment point affixed to said board;

c) at least one body attachment fastener for attachment to a part of a person; and d) one or more resistance bands, each resistance band comprised of a length of resistive elastic tubing having affixed at a first end a hook and an opposite end a hook, wherein each of the one or more resistance bands is detachably connected to an attachment point by means of connecting a hook at the first end to the attachment point, and the hook at the opposite end to a body attachment fastener, and wherein some attachment points are arranged in a semi-circular shape around the center of the board.

7. The exercise system of claim 1, wherein the attachment points are labeled to instruct on the placement of hands and feet of the person.

8. The exercise system of claim 1, wherein each attachment point has a sleeve around it to reduce rotational friction.

9. The exercise system of claim 1, wherein each resistance band further comprises a sleeve for reducing sliding friction and preventing the tubing from being stretched beyond a limit.

10. The exercise system of claim 1, wherein resistive elastic tubing is rubber.

11. The exercise system of claim 1, wherein the hook is a snap hook.

12. The exercise system of claim 1, wherein the body attachment fastener is a handle or a bar.

13. The exercise system of claim 1, wherein the body attachment fastener is an ankle strap, the strap comprising:

a) a piece of webbing with fastening means, such that the piece of material may be fastened to itself by the fastening means;

b) a foot strap with fastening means;

c) a metal ring affixed to said piece of webbing perpendicular to the orientation of the webbing; and d) a bumper to cushion the metal ring against an ankle wherein said ankle strap is fastened around the ankle by fastening means, said foot strap is affixed to said ankle strap, and is fastened around a foot by fastening means, to keep the ankle strap in close proximity to the foot.

14. A portable free-motion exercise system for strengthening and rehabilitating muscles and organs, comprising:

a) a rigid board having a non-slip surface;

b) a plurality of attachment points on said board, each attachment point having a ring-like feature for attachment of a hook, each attachment point affixed to said board;

c) at least one body attachment fastener for attachment to a part of a person;

d) one or more resistance bands, each resistance band comprised of a length of resistive elastic tubing having affixed at a first end a hook and an opposite end a hook; and e) a door attachment point for mounting within a door, the door attachment point comprising:

i) a strap having a first loop at one end containing a ring held therein, the ring for attachment to a resistance band;

ii) the strap further having a second loop containing a dowel at the opposite end, for placement behind a door; and iii) the strap further having a third loop positioned between the first and second loops, the third loop containing a stopper for resisting movement of the door attachment vertically within the door, wherein each of the one or more resistance bands is detachably connected to an attachment point by means of connecting a hook at the first end to the attachment point, and the hook at the opposite end to a body attachment fastener.

15. A method of using the exercise system of claim 1, comprising the following steps:

a) connecting a first end of one or more resistance bands to one or more first attachment points;

b) feeding the resistance band through one or more second attachment points;

c) connecting a second end of said resistance bands to one or more body attachment fasteners;

d) stabilizing the board with oppositional forces; and e) applying force to said body attachment fasteners one or more times.

* * * * *